US009657916B2

(12) United States Patent
Hussey et al.

(10) Patent No.: US 9,657,916 B2
(45) Date of Patent: May 23, 2017

(54) LIGHTING DEVICE INCLUDING MULTIPLE DIFFUSERS FOR BLENDING LIGHT

(71) Applicants: Andrew Hussey, Stow, OH (US); Timothy Chen, Aurora, OH (US); George Uhler, Wadsworth, OH (US); Andrew Forchione, Massillon, OH (US)

(72) Inventors: Andrew Hussey, Stow, OH (US); Timothy Chen, Aurora, OH (US); George Uhler, Wadsworth, OH (US); Andrew Forchione, Massillon, OH (US)

(73) Assignee: TECHNICAL CONSUMER PRODUCTS, INC., Aurora, OH (US)

( * ) Notice: Subject to any disclaimer, the term of this patent is extended or adjusted under 35 U.S.C. 154(b) by 50 days.

(21) Appl. No.: 14/723,532

(22) Filed: May 28, 2015

(65) Prior Publication Data

US 2016/0348850 A1 Dec. 1, 2016

(51) Int. Cl.

| | |
|---|---|
| ***F21V 3/02*** | (2006.01) |
| ***F21V 17/16*** | (2006.01) |
| ***F21V 23/00*** | (2015.01) |
| ***F21K 9/232*** | (2016.01) |
| ***F21K 9/238*** | (2016.01) |

(Continued)

(52) U.S. Cl.

CPC ..... *F21V 3/02* (2013.01); *F21K 9/232* (2016.08); *F21K 9/238* (2016.08); *F21V 3/0472* (2013.01); *F21V 17/164* (2013.01); *F21V 23/006* (2013.01); *F21V 3/0418* (2013.01); *F21V 3/0436* (2013.01); *F21Y 2115/10* (2016.08)

(58) Field of Classification Search

CPC ... F21K 9/135; F21K 9/50; F21K 9/00; F21K 9/238; F21K 9/232; F21V 5/002; F21V 5/007; F21V 5/008; F21V 5/08; F21V 17/16; F21V 17/00; F21V 17/10; F21V 3/02; F21V 3/0472; F21V 17/164; F21V 23/006; F21V 3/0418; F21V 3/0436; F21Y 2115/10

See application file for complete search history.

(56) References Cited

U.S. PATENT DOCUMENTS 6,352,359 B1 * 3/2002 Shie ..... F21S 48/1233 362/331
7,828,467 B2 * 11/2010 Lee ..... F21S 8/08 362/237

(Continued)

OTHER PUBLICATIONS

PCT, International Search Report and Written Opinion, International Application No. PCT/US2016/032978 (Aug. 23, 2016).

*Primary Examiner* — Bao Q Truong
(74) *Attorney, Agent, or Firm* — Thompson Hine LLP

(57) ABSTRACT

A lighting device is disclosed, and includes at least one lighting element for emitting light, an inner diffuser, and an outer diffuser. The inner diffuser defines a lighting cavity and an outer surface, where the at least one lighting element is located within the lighting cavity. The outer diffuser surrounds the inner diffuser. The outer diffuser defines an inner surface. The outer surface of the inner diffuser and the inner surface of the outer diffuser cooperate together to define a space between the inner diffuser and the outer diffuser. The inner diffuser and the outer diffuser spread and blend the light emitted by the at least one lighting element.

21 Claims, 3 Drawing Sheets

(51) Int. Cl.
*F21V 3/04* (2006.01)
*F21Y 115/10* (2016.01)

(56) References Cited

U.S. PATENT DOCUMENTS

| | | | | |
|---|---|---|---|---|
| 8,026,655 | B2 * | 9/2011 | Arndt | H01J 5/60 313/312 |
| 8,454,206 | B2 * | 6/2013 | Chang | F21S 6/002 362/246 |
| 8,519,603 | B2 * | 8/2013 | Yang | F21K 9/00 313/46 |
| 8,975,806 | B2 * | 3/2015 | Kitagawa | F21V 3/02 313/110 |
| 9,057,497 | B2 * | 6/2015 | Bakk | F21K 9/00 |
| 9,185,773 | B2 * | 11/2015 | Yotsumoto | H05B 37/00 |
| 9,328,913 | B2 * | 5/2016 | Yotsumoto | F21V 33/0056 |
| 9,416,958 | B2 * | 8/2016 | Yotsumoto | F21V 23/0435 |
| 9,488,352 | B2 * | 11/2016 | Hussey | F21V 23/006 |
| 2005/0090124 | A1 | 4/2005 | Mohacsi et al. | |
| 2012/0155059 | A1 | 6/2012 | Hoelen et al. | |
| 2013/0051002 | A1 | 2/2013 | Draper et al. | |
| 2013/0154519 | A1 | 6/2013 | Riesebosch | |
| 2014/0268727 | A1 | 9/2014 | Amrine, Jr. et al. | |
| 2015/0070895 | A1 * | 3/2015 | Yotsumoto | F21V 3/02 362/253 |

* cited by examiner

LIGHTING DEVICE INCLUDING MULTIPLE DIFFUSERS FOR BLENDING LIGHT

TECHNICAL FIELD

The present disclosure relates generally to a lighting device, and more particularly to a lighting device including two or more diffusers for blending light.

BACKGROUND

Light emitting diode (LED) based lighting systems may offer several energy and reliability advantages over other types of lighting systems such as, for example, incandescent or fluorescent lighting. Thus, LED based lighting systems may be used to replace other existing lighting technologies. Multicolored LED chips are commonly used in lighting applications where dynamic color mixing is desired. For example, light emitted from different colored LED chips may be mixed together and their respective brightness adjusted in order to produce white light.

One of the challenges faced in a multicolored application is mixing or blending the different colored LED chips properly so as to create uniform light. For example, red, green, and blue light produced by individual LEDs may need to be mixed or blended together to create white light. However, sometimes the light blending is not always consistent. In one approach to alleviate this issue, a solid object may be placed within a lighting device, between the individual LEDs and the diffuser in order to block the light that does not get mixed properly. In another approach, the light sources (e.g., the LEDs) may be positioned closer together such that the light the LEDs generate appears to be combined when viewed from the outside of the light bulb.

In addition to the mixing of light, another challenge faced in LED lighting is the issue of shadowing upon a diffuser of the light bulb. Specifically, sometimes shadows may be cast by objects located within a lighting cavity of the light bulb upon the diffuser. For example, in some types of lamps, the electronic driver circuit board may actually protrude into the lighting cavity. The driver circuit board may cast shadows upon the diffuser of the light bulb. In addition to the electronic driver circuit, other objects located within the lighting cavity that may cast a shadow on the diffuser include, but are not limited to, screws, wires, antennas, and reflectors. Accordingly, the physical structure of the lamp may need to be modified in order to prevent shadows from being cast upon the diffuser. Thus, there exists a continuing need in the art for a lighting device having improved light generating characteristics.

SUMMARY

In one embodiment, a lighting device is disclosed, and includes at least one lighting element that emits light, an inner diffuser and an outer diffuser. The inner diffuser defines a lighting cavity and an outer surface, where the at least one lighting element is located within the lighting cavity. The outer diffuser surrounds the inner diffuser. The outer diffuser defines an inner surface. The outer surface of the inner diffuser and the inner surface of the outer diffuser cooperate together to define a space between the inner diffuser and the outer diffuser. The inner diffuser and the outer diffuser spread and blend the light emitted by the at least one lighting element.

In another embodiment, a light emitting diode (LED) light bulb is disclosed, and includes at least one LED for generating light, an inner diffuser, and an outer diffuser. The inner diffuser defines a lighting cavity and an outer surface. The LED is located within the lighting cavity. The outer diffuser surrounds the inner diffuser. The outer diffuser defines an inner surface. The outer surface of the inner diffuser and the inner surface of the outer diffuser cooperate together to define a space between the inner diffuser and the outer diffuser. The inner diffuser and the outer diffuser spread and blend the light generated by the LED.

DETAILED DESCRIPTION

Figure 1:
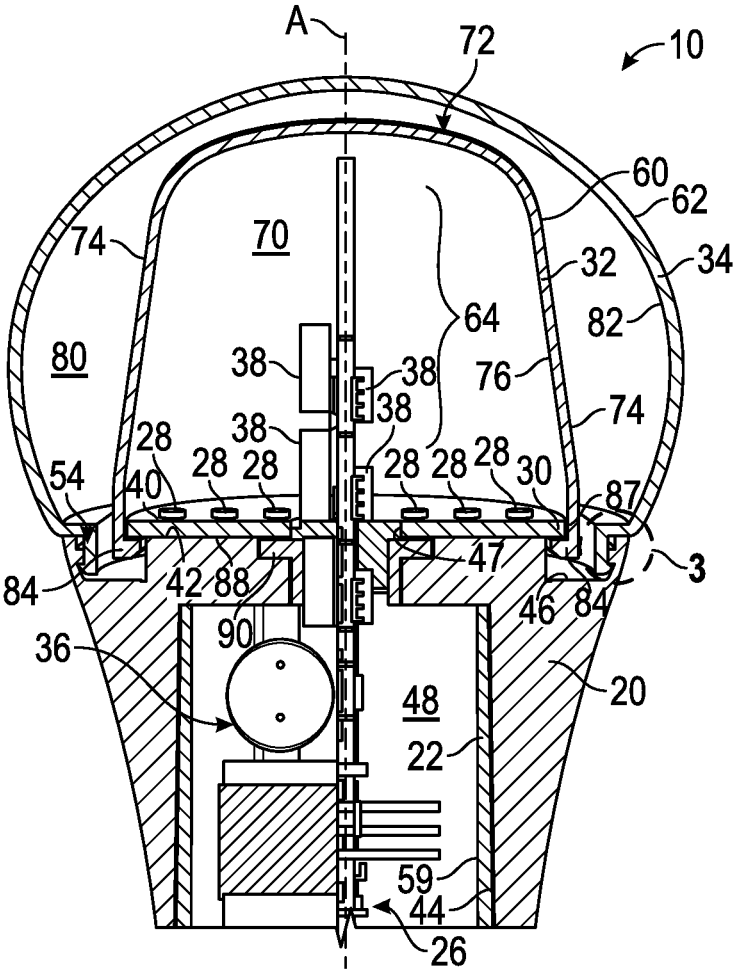
FIG. 1 is a cross-sectioned view of an exemplary a lighting device including two diffusers.

The following detailed description will illustrate the general principles of the invention, examples of which are additionally illustrated in the accompanying drawings. In the drawings, like reference numbers indicate identical or functionally similar elements.

Figure 2:
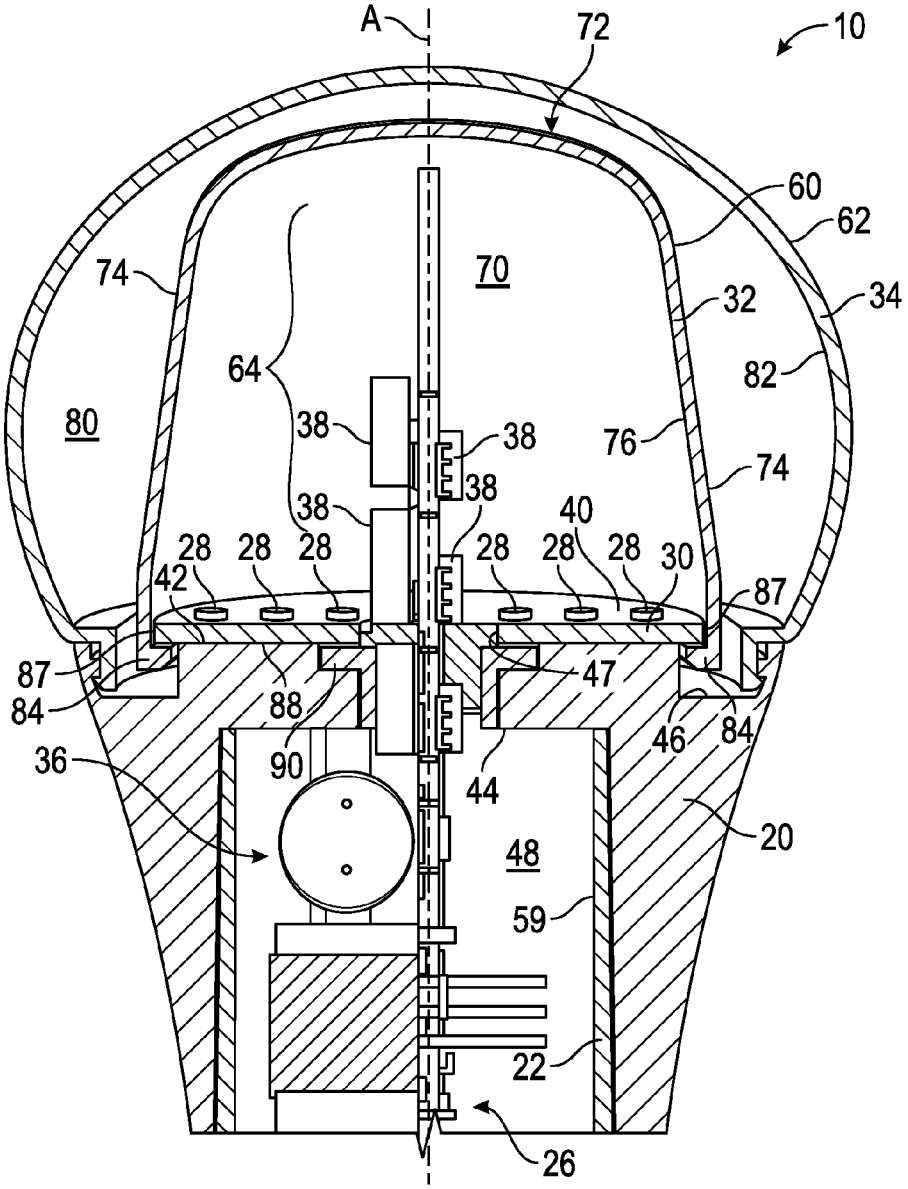
FIG. 2 is an enlarged view of the lighting device shown in FIG. 1.

FIGS. 1-2 are a cross-sectioned view of a portion of an exemplary lighting device 10. In the embodiment as shown, the lighting device 10 may include a first housing 20, a sleeve or second housing 22, a driver board 26, a one or more lighting elements 28, a lighting element board 30, a first or inner diffuser 32, and a second or outer diffuser 34. The first housing 20 may be attached or is part of a socket base of the lighting device 10 (not illustrated). In the embodiment as shown, the lighting elements 28 are disposed along an upper surface 40 of the lighting element board 30. The lighting elements 28 may be light emitting diodes (LEDs). Those skilled in the art will appreciate that although the lamp 10 is illustrated as a type A light bulb, the disclosure should not be limited to a specific type of lamp. Indeed, any type of illumination device for transmitting visible light may be used as well such as, but not limited to, edge-lit lighting fixtures, liquid crystal display (LCD) backlighting, commercial and residential downlighting, wireless lighting fixtures, and string lighting (also referred to as holiday lighting).

Continuing to refer to FIGS. 1-2, in one non-limiting embodiment the first housing 20 may be constructed of a heat-conducting metal such as, for example, aluminium or a metal alloy. Alternatively, in another embodiment, the first housing 20 may be constructed of a thermally conductive plastic. The first housing 20 may include a centrally located aperture 44 and a recess 46. In the embodiment as shown, the aperture 44 of the first housing 20 is positioned along a central axis A-A of the lamp 10, however it is to be understood that the disclosure should not be limited to this specific arrangement. The recess 46 of the first housing 20 may be disposed along a top surface 42 of the first housing 20. The lighting element board 30 may also define an aperture 47 that may be substantially aligned with the aperture 44 of the first housing 20.

Figure 3:
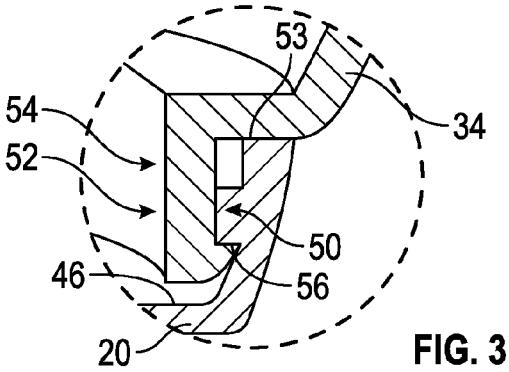
FIG. 3 is an illustration of Area A in FIG. 1.

FIG. 3 is an enlarged view of Area A shown in FIG. 1. As seen in FIG. 3, the recess 46 of the first housing 20 defines a shelf or projection 50 located directly adjacent to an outer perimeter 53 of the first housing 20. The projection 50 of the first housing 20 is shaped to engage with one or more resilient fingers or tabs 52 located along a bottom portion 54 of the outer diffuser 34. Specifically, as the lamp 10 is assembled, the tabs 52 of the outer diffuser 34 may slide over the projection 50 and eventually abut against a lower surface 56 of the projection 50 to thereby create a snap-fit engagement between the first housing 20 and the outer diffuser 34. The snap-fit engagement between the first housing 20 and the outer diffuser 34 may eliminate the need for fasteners or adhesive to secure the outer diffuser 34 to the lighting device 10.

Figure 4:
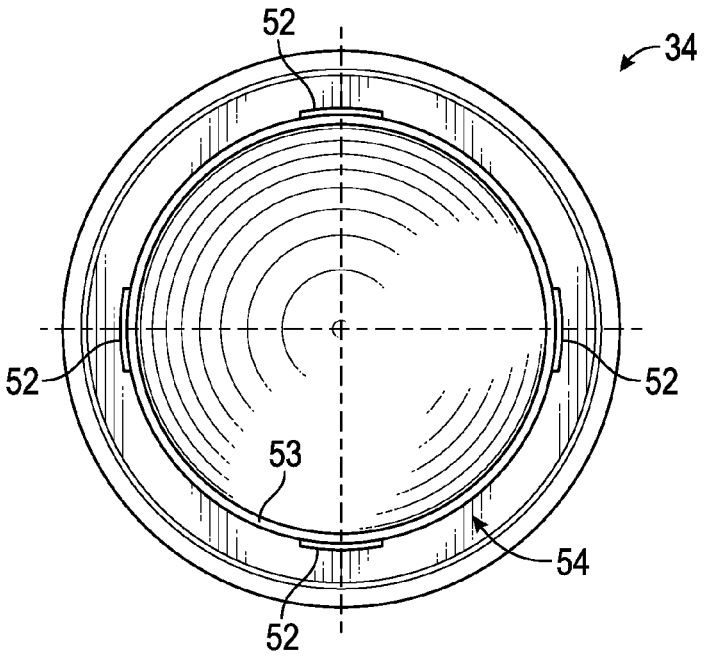
FIG. 4 is a bottom view of an outer diffuser shown in FIG. 1-2.

FIG. 4 is an illustration of the bottom portion 54 of the outer diffuser 34. As seen in FIG. 4, the outer diffuser 34 may include four equally spaced tabs 52 for engaging the projection 50 of the first housing 20 (FIGS. 1-2). Although FIG. 4 illustrates the outer diffuser 34 having four equally spaced tabs 52, those of ordinary skill in the art will readily appreciate that this illustration is merely exemplary in nature and the disclosure should not be limited to just four tabs 52. Indeed, the outer diffuser 34 may include any number of tabs 52 for engagement with the first housing 20.

Turning back to FIGS. 1-2, the driver board 26 may include various power electronics 36, as well as one or more microcontrollers 38. In one embodiment, the driver board 26 may be a printed circuit board (PCB). The driver board 26 is electrically coupled to and delivers power to the lighting elements 28. A portion of the driver board 26 may be positioned within a cavity 48 that is defined by the aperture 44 of the first housing 20 as well as an aperture 59 defined by the second housing 22.

The inner diffuser 32 and the outer diffuser 34 may both be any device for spreading and blending light emitted by the lighting elements 28. The inner diffuser 32 and the outer diffuser 34 may both be constructed of any material that allows for the spreading and blending of light such as, for example, plastic such as polycarbonate, or glass. In one embodiment, an outer surface 60 of the inner diffuser 32 may be coated with a material that causes the light generated by the lighting elements 28 to have a specific appearance. For example, if the lighting device 10 is a white light bulb, then the outer surface 60 of the inner diffuser 32 may be coated with white titanium dioxide particles. Additionally or alternatively, an outer surface 62 of the outer diffuser 34 may also be coated with a material as well, such as white titanium dioxide particles.

In one embodiment, the inner diffuser 32 may be constructed of a different material than the outer diffuser 34. For example, in one approach the inner diffuser 32 may be constructed of a plastic, such as polycarbonate, while the outer diffuser 34 may be constructed of glass in order to emulate a traditional light bulb. In an alternative embodiment, both the inner diffuser 32 and the outer diffuser 34 are both constructed of the same material.

Continuing to refer to FIG. 1-2, the inner diffuser 32 may be surrounded and contained by the outer diffuser 34. The lighting elements 28, the lighting element board 30, and an upper portion 64 of the driver board 26 may be surrounded and contained by the inner diffuser 32 when the lighting device 10 is assembled. Specifically, the inner diffuser 32 defines a lighting cavity 70. The lighting cavity 70 is sized to contain the lighting elements 28, the lighting element board 30, and the upper portion 64 of the driver board 26. In the embodiment as shown, the lighting cavity 70 is an empty space that may be filled with air. However, it is to be understood that this embodiment is not limiting in nature, and the lighting cavity 70 could be a vacuum as well. As seen in the figures, the driver board 26 projects in an upwards direction and into the lighting cavity 70 defined by the inner diffuser 32. The driver board 26 may be located along the central axis A-A of the lamp 10, however it is to be understood the driver board 26 may also be offset from the central axis A-A as well.

As seen in FIGS. 1-2, the geometry of the inner diffuser 32 includes a rounded or curved end portion 72 and inwardly tapered sides 74. However, it is to be understood that the inner diffuser 32 may include any number of shapes and geometries as well. The specific shape of the inner diffuser 32 may be dictated or defined by the geometry or size of the components located within the lighting cavity 70 such as the lighting element board 30 and the upper portion 64 of the driver board 26. For example, if the upper portion 64 the driver board 26 projects into the lighting cavity 70, the inner diffuser 32 should be sized such that the driver board 26 does not abut against or create an interfere with an inner surface 76 of the inner diffuser 32. Although a driver board 26 is discussed, it is to be understood that the lighting cavity 70 may be shaped to contain other objects that protrude into the lighting cavity 70 as well. Some examples of components that may project into the lighting cavity 70 include, but are not limited to, screws, wires, and antennas (not shown in the figures).

A gap or space 80 may be defined between the inner diffuser 32 and the outer diffuser 34. In one embodiment, the space 80 may be an air-filled gap. Alternatively, the space 80 may be a vacuum instead. In another embodiment, the space 80 may be filled with a material that allows for the transmission of light such as, but not limited to, clear silicon. The outer surface 60 of the inner diffuser 32 and an inner surface 82 of the outer diffuser 34 cooperate together to define the space 80. It is to be understood the geometry or volume of the space 80 should not be limited to the specific configuration as shown in the figures. It is to be understood that the outer surfacer 60 of the inner diffuser 32 may even contact or touch the inner surface 82 of the outer diffuser 34 in one embodiment.

In the embodiment as shown, the outer diffuser 34 includes a generally rounded or dome-shaped profile that corresponds to a type A light bulb. However, it is to be understood that this illustration is merely exemplary in nature. Indeed, the outer diffuser 34 may include any number of shapes or geometries so long as the outer diffuser 34 contains and surrounds the inner diffuser 32. Moreover, as explained above, the outer surface 60 of the inner diffuser 32 may contact the inner surface 82 of the outer diffuser 34.

It is to be understood that providing at least two diffusers for the lighting device 10 (i.e., the inner diffuser 32 and the outer diffuser 34) generally improves light output. More specifically, objects located within the lighting cavity 70 (such as the upper portion 64 the driver board 26) may cast shadows upon the inner diffuser 32. However, because the lighting device 10 includes an additional diffuser (i.e., the outer diffuser 34) for further distribution of light, the shadows created by objects located within the lighting cavity 70 may not be noticeable as the light generated by the lighting elements 28 exits the outer diffuser 34. In other words, the use of multiple diffusers substantially eliminate any shadows created by objects located within the lighting cavity 70 to be cast upon the outer diffuser 34.

It should also be understood that while the figures illustrates two diffusers (i.e., the inner diffuser 32 and the outer diffuser 34), the lighting device 10 should not be limited to just two diffusers. Instead, the disclosed lighting device 10 may include more than two diffusers as well, where each diffuser may be contained by another diffuser that is larger in size. Moreover, while the figures illustrate the inner diffuser 32 having a different geometry than the outer diffuser 34, it is to be understood that the inner diffuser 32 may include a similar shape as the outer diffuser 34, but is smaller in size such that the inner diffuser 32 may fit within the outer diffuser 34.

Referring to both FIGS. 1 and 2, the curved end portion 72 of the inner diffuser 32 is spherical in shape and generally corresponds with a portion of the rounded or dome-shaped profile of the outer diffuser 34. However, the tapered sides 74 of the inner diffuser 32 are tapered and do not correspond with the dome-shaped profile of the outer diffuser 34. In other words, the illustrated embodiment shows a portion of the inner diffuser 32 corresponding with the outer diffuser 34, while a remaining portion of the inner diffuser 32 is shaped in a different configuration so as to not correspond with the dome-shaped profile of the outer diffuser 34.

In the exemplary embodiment as shown in the figures, the lighting elements 28 are each individual LEDs. For example, in one embodiment, the individual lighting elements 28 (e.g., the LEDs) may be differently colored LEDs, such as red, green, and blue LEDs. The light emitted from the differently colored LEDs may be mixed together by the inner diffuser 32 and the outer diffuser 34 in order to produce white light. It is to be understood that providing multiple diffusers generally enhances and improves the amount of color mixing between the differently colored LEDs, thereby providing a more uniform white light.

Although a uniform white light is discussed, it should be understood that the lighting device 10 is not limited to just producing white light. For example, in another embodiment, the lighting device 10 may produce a light of a different wavelength instead such as, for example, red, green, blue, orange, pink, or violet light. Moreover, it is to be understood that the disclosure is not limited to LED lighting, and the lighting elements 28 may be other types of light emitting elements instead. For example, in another embodiment, the lighting device 10 may be a compact fluorescent light (CFL), or an incandescent light. Moreover, it should also be understood that in another embodiment, the lighting elements 28 may actually reflect light generated from another light source (not shown) that is located within the lighting device 10, or even by a source external to the lighting device 10. For example, the lighting elements 28 may be mirrors or reflectors that may reflect the light generated from the sun.

Figure 5:
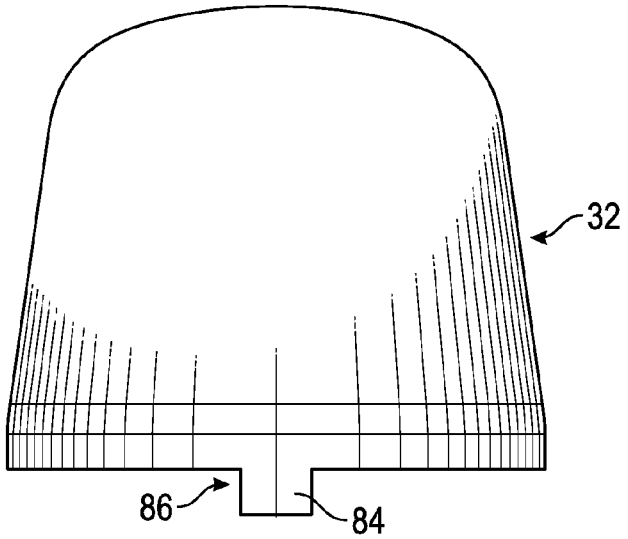
FIG. 5 is a side view of an inner diffuser shown in FIG. 1-2.
Figure 6:
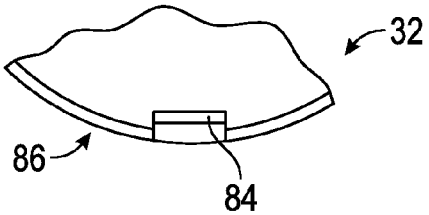
FIG. 6 is a bottom view of a portion of the inner diffuser shown in FIG. 5, illustrating one of the two tabs of the inner diffuser.

Referring to FIGS. 1-2 and 5-6, in one embodiment the inner diffuser 32 may include two resilient fingers or tabs 84 located along a bottom portion 86 of the inner diffuser 32 (only one of the tabs 84 are visible in FIG. 5). It should be understood that while the inner diffuser 32 is illustrated as having two tabs 84, any number of tabs may be used as well. When the lighting device 10 is assembled, the tabs 84 of the inner diffuser 32 slide over an outer periphery 87 of the lighting board 30. The tabs 84 eventually abut against a lower surface 88 of the lighting board 30 to form a snap-fit engagement between the lighting board 30 and the inner diffuser 32. This snap-fit engagement may eliminate the need for fasteners or adhesive to secure the inner diffuser 32 to the lighting device 10.

Continuing to refer to FIGS. 1-2, an insert ring 90 may be shaped to fit within the aperture 44 of the first housing 20. The insert ring 90 may be constructed of an electrical insulator such as, for example, plastic. The insert ring 90 may be placed within the aperture 44 of the first housing 20 when the lighting fixture 10 is assembled. The upper end portion 64 of the driver board 26 may be received by the insert ring 90. In other words, the insert ring 90 may surround the upper end portion 64 of the driver board 26. The insert ring 90 may be used to provide electrical insulation between the driver board 26 and the first housing 20 (if the first housing 20 is constructed of metal) as well as the lighting element board 30.

Referring generally to the figures, the disclosed lighting device 10 generates more uniform light when compared to some other types of lighting devices currently available that only include a single, outer diffuser. This is because the multiple diffusers cooperate together to distribute the light generated by the lighting elements 28. The multiple diffusers allow for objects, such as the driver board 26, to protrude into the lighting cavity 70 of the lighting device 10, without creating objectionable shadowing along the outer surface 62 of the outer diffuser 34. Moreover, the disclosed lighting device 10 may also result in enhanced color mixing between differently colored LEDs.

While the forms of apparatus and methods herein described constitute preferred embodiments of this invention, it is to be understood that the invention is not limited to these precise forms of apparatus and methods, and the changes may be made therein without departing from the scope of the invention.

What is claimed is:

1. A lighting device, comprising:

a housing defining a cavity;

at least one lighting element for emitting light;

a driver board coupled to and providing power to the at least one lighting element, wherein the driver board defines an upper portion and a lower portion, and wherein the lower portion of the driver board is located within the cavity of the housing;

an inner diffuser defining a lighting cavity and an outer surface, wherein the lighting cavity is sized to contain the at least one lighting element and the upper portion of the driver board; and an outer diffuser surrounding the inner diffuser, the outer diffuser defining an inner surface, wherein the outer surface of the inner diffuser and the inner surface of the outer diffuser cooperate together to define a space between the inner diffuser and the outer diffuser, and wherein the inner diffuser and the outer diffuser spread and blend the light emitted by the at least one lighting element and substantially eliminate any shadows created by the upper portion of the driver board within the lighting cavity.

2. The lighting device recited in claim 1, wherein the space between the inner diffuser and the outer diffuser is filled with one of air and a material that allows for transmission of light.

3. The lighting device recited in claim 1, wherein the space between the inner diffuser and the outer diffuser is a vacuum.

4. The lighting device recited in claim 1, wherein the lighting device comprises a plurality of lighting elements.

5. The lighting device recited in claim 4, wherein the plurality of lighting elements are a plurality of light emitting diodes (LEDs).

6. The lighting device recited in claim 5, wherein the plurality LEDs are differently colored and the lighting generated by each of the plurality of LEDs are mixed together to produce white light.

7. The lighting device recited in claim 1, wherein the inner diffuser and the outer diffuser are constructed of different materials.

8. The lighting device recited in claim 1, wherein the outer diffuser includes a generally dome-shaped profile.

9. The lighting device recited in claim 1, wherein the inner diffuser includes curved end portion and inwardly tapered sides.

10. The lighting device recited in claim 1, wherein the housing defines a recess and a projection located within the recess.

11. The lighting device recited in claim 10, wherein the outer diffuser includes a plurality of tabs that abut against the projection of the housing to create a snap-fit engagement between the housing and the outer diffuser.

12. The lighting device recited in claim 1, comprising a lighting board having an upper surface and a lower surface, wherein the at least one lighting element is disposed along the upper surface of the lighting board.

13. The lighting device recited in claim 12, wherein the inner diffuser includes a plurality of tabs that abut against the lower surface of the lighting board to create a snap-fit engagement between the lighting board and the inner diffuser.

14. A light emitting diode (LED) light bulb, comprising:

a housing defining a cavity;

at least one LED for generating light;

a driver board coupled to and providing power to the at least LED, wherein the driver board defines an upper portion and a lower portion, and wherein the lower portion of the driver board is located within the cavity of the housing;

an inner diffuser defining a lighting cavity and an outer surface, wherein the lighting cavity is sized to contain the at least one LED and the upper portion of the driver board; and an outer diffuser surrounding the inner diffuser, the outer diffuser defining an inner surface, wherein the outer surface of the inner diffuser and the inner surface of the outer diffuser cooperate together to define a space between the inner diffuser and the outer diffuser, and wherein the inner diffuser and the outer diffuser spread and blend the light generated by the at least one LED and substantially eliminate any shadows created by the upper portion of the driver board within the lighting cavity.

15. The LED light bulb recited in claim 14, wherein the space between the inner diffuser and the outer diffuser is filled with one of air and a material that allows for transmission of light.

16. The LED light bulb recited in claim 14, wherein the space between the inner diffuser and the outer diffuser is a vacuum.

17. The LED light bulb recited in claim 14, comprising a plurality of LEDs, wherein the plurality LEDs are differently colored and the light generated by each of the plurality of LEDs are mixed together to produce white light.

18. The LED light bulb recited in claim 14, wherein the housing defines a recess and a projection located within the recess.

19. The LED light bulb recited in claim 18, wherein the outer diffuser includes a plurality of tabs that abut against the projection of the housing to create a snap-fit engagement between the housing and the outer diffuser.

20. The LED light bulb recited in claim 14, comprising a lighting board having an upper surface and a lower surface, wherein the at least one lighting element is disposed along the upper surface of the lighting board.

21. The LED light bulb recited in claim 20, wherein the inner diffuser includes a plurality of tabs that abut against the lower surface of the lighting board to create a snap-fit engagement between the lighting board and the inner diffuser.

* * * * *